US007837322B2

(12) United States Patent
Kusuhata

(10) Patent No.: US 7,837,322 B2
(45) Date of Patent: Nov. 23, 2010

(54) PRINTING APPARATUS HAVING DECURLING FUNCTION

(75) Inventor: Masahiko Kusuhata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 34 days.

(21) Appl. No.: 12/457,234

(22) Filed: Jun. 4, 2009

(65) Prior Publication Data

US 2009/0309912 A1 Dec. 17, 2009

(30) Foreign Application Priority Data

Jun. 16, 2008 (JP) ..... P2008-157135

(51) Int. Cl.
*B41J 2/01* (2006.01)

(52) U.S. Cl. ..... 347/104; 347/101; 400/578

(58) Field of Classification Search ..... 347/101, 347/104; 400/578
See application file for complete search history.

(56) References Cited

U.S. PATENT DOCUMENTS 6,257,783 B1 * 7/2001 Hanaoka et al. ..... 400/578
2007/0008398 A1 * 1/2007 Cloutier et al. ..... 347/218

FOREIGN PATENT DOCUMENTS

JP 2006-264828 A 10/2006

* cited by examiner

*Primary Examiner*—Matthew Luu
*Assistant Examiner*—Brian J Goldberg
(74) *Attorney, Agent, or Firm*—The Nath Law Group; Jerald L. Meyer

(57) ABSTRACT

A printing apparatus is provided with a circulation route through which a print sheet can be circulated a minimum number of times to avoid the overall print process time from being elongated. The circulation route includes an ordinary transportation route CR which transports a print sheet for printing and discharging through a discharge route, and a switchback route SR which is connected to the ordinary transportation route CR as a branch, such that the print sheet can be circulated a plural number of times. The printing apparatus is provided further with a print coverage detecting unit 332*c* for calculating the print coverage of each print sheet, a circulation repeat number determination unit 332*b* for determining the number of circulations for each print sheet in accordance with the print coverage, a paper discharge control unit 334*a* for selectively discharging each print sheet in accordance with the number of circulations.

7 Claims, 8 Drawing Sheets

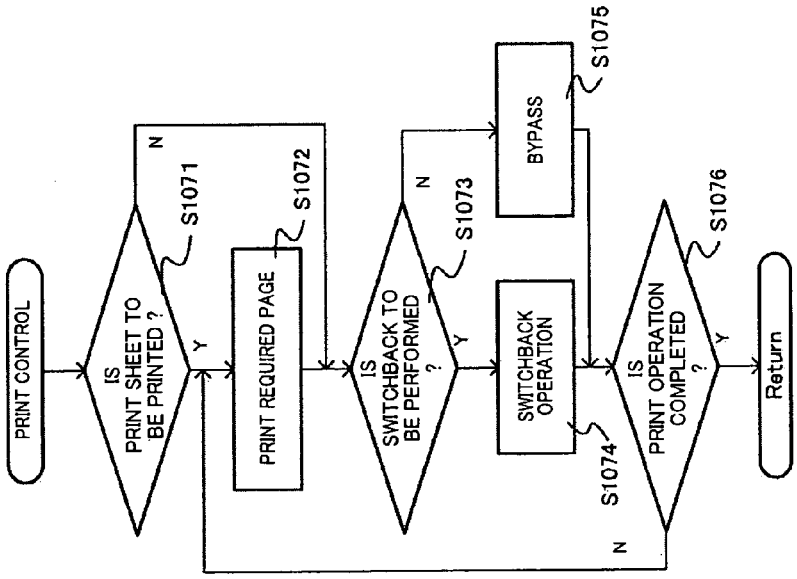
Fig. 4B
Fig. 4A
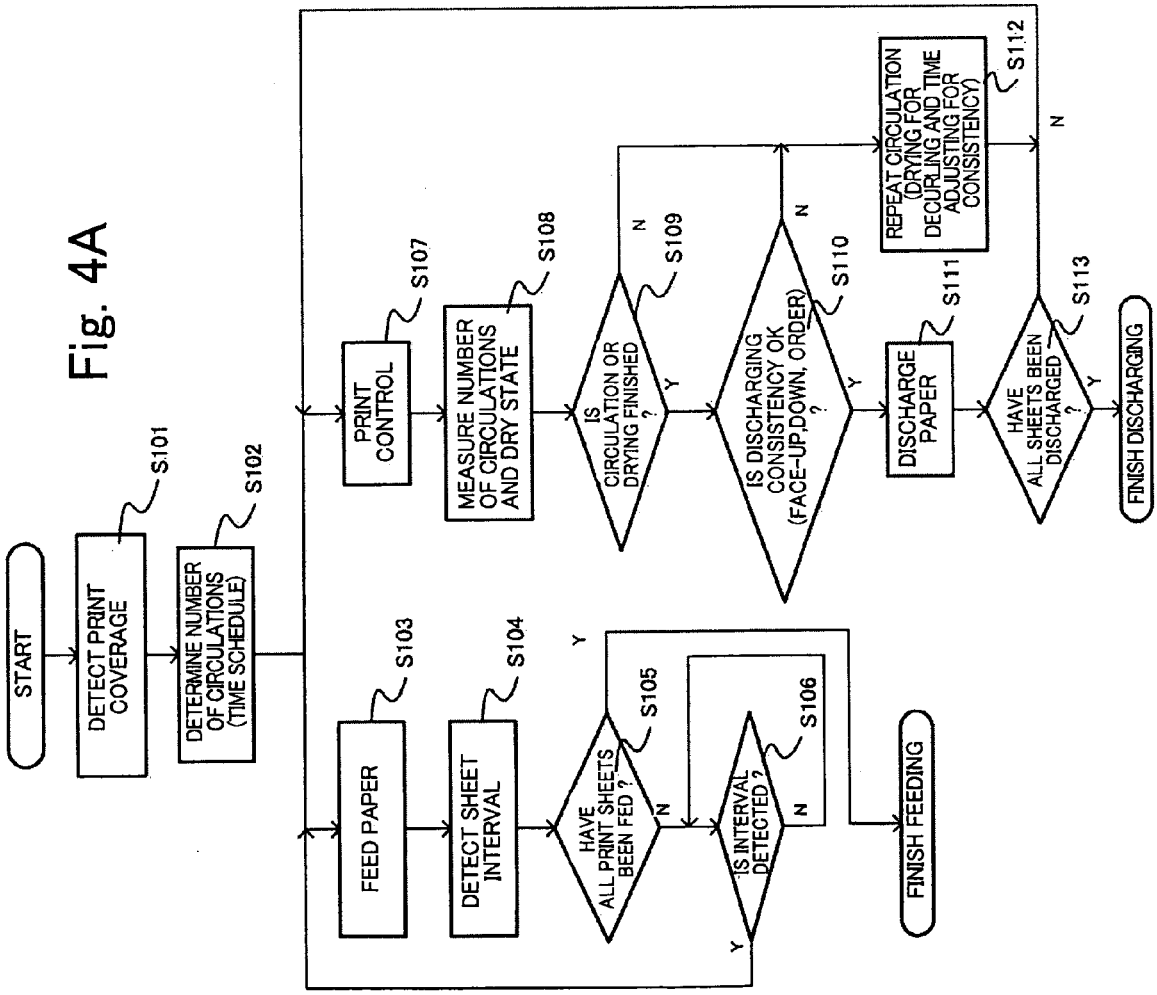

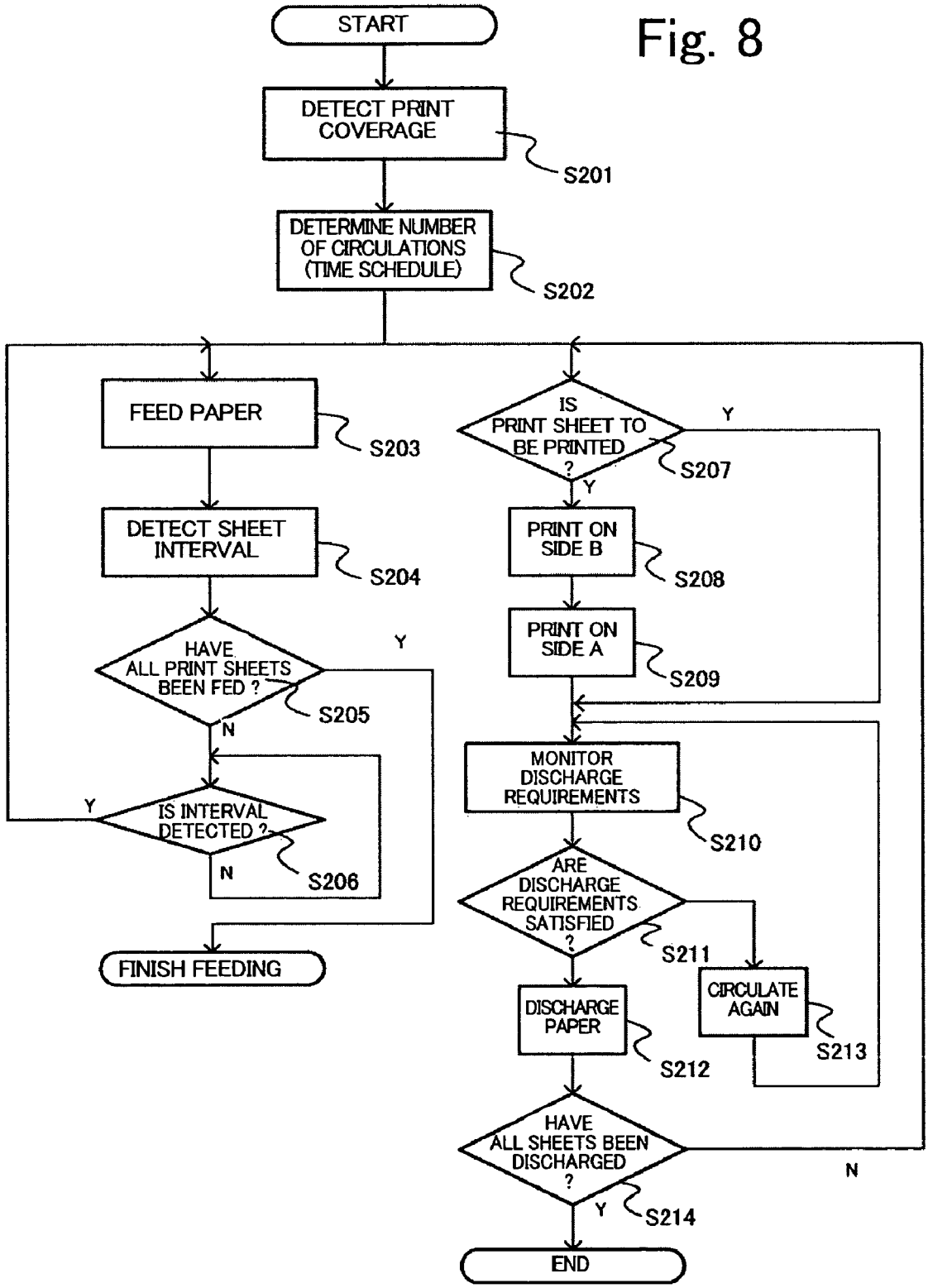
Fig. 8
START
DETECT PRINT COVERAGE
S201
DETERMINE NUMBER OF CIRCULATIONS (TIME SCHEDULE)
S202
FEED PAPER
S203
DETECT SHEET INTERVAL
S204
HAVE ALL PRINT SHEETS BEEN FED ?
S205
Y
N
IS INTERVAL DETECTED ?
S206
Y
N
FINISH FEEDING
IS PRINT SHEET TO BE PRINTED ?
S207
Y
Y
PRINT ON SIDE B
S208
PRINT ON SIDE A
S209
MONITOR DISCHARGE REQUIREMENTS
S210
ARE DISCHARGE REQUIREMENTS SATISFIED ?
S211
CIRCULATE AGAIN
S213
DISCHARGE PAPER
S212
HAVE ALL SHEETS BEEN DISCHARGED ?
S214
Y
N
END

PRINTING APPARATUS HAVING DECURLING FUNCTION

BACKGROUND OF THE INVENTION

Field of the Invention

The present invention relates generally to a printing apparatus for forming images on a print sheet transported on a transportation route, and more particularly relates to a printing apparatus having a decurling function of preventing a printed sheet from being curled.

Conventionally, in the case of printing apparatuses such as ink jet printers, a curl or bend is sometimes induced in a print sheet when printing because of the moisture originating from an aqueous ink which makes the print sheet somewhat wet on the printed side. The print sheet is curled just after the print process. However, the ink printed on the print sheet dries as time passes such that the amount of curl decreases. Because of this, in the prior art technique, it is proposed to provide a waiting time for drying ink and decurling the print sheet, followed by discharging the decurled print sheet, rather than discharging the print sheet just after the print process.

The technique of providing a waiting time for drying ink is performed, for example, by circulating the printed sheet along a circulating route provided in a printer such as described in Japanese Patent Published Application No. 2006-264828. In the case of the technique described in Japanese Patent Published Application No. 2006-264828, the entirety of the printed material is circulated a number of times which is determined in accordance with the print options as set.

However, when the printed material consists of a plurality of document sheets which require different numbers of circulations, the document sheets cannot be discharged in the correct order if one sheet is circulated a larger number of times than other sheets. Thereby, in the case of the technique described in Japanese Patent Published Application No. 2006-264828, all the constituent document sheets are circulated the number of times which is largest among the required numbers of times the consistent documents are to be circulated, in order to maintain the consistency of the order of discharging these document sheets.

Because of this, since the total number of circulations substantially increases for a printed material consisting of a plurality of sheets in accordance with the technique described in Japanese Patent Published Application No. 2006-264828, it takes a long time to complete the print process. More specifically speaking, in the case where the constituent print sheets of a document require the different numbers of circulations, which take different times after feeding the print sheet until discharging the print sheet, if the print sheets are discharged in the order in which decurling is finished, the discharging order becomes different from the order of printing as intended, and thereby all the constituent document sheets are circulated the number of times which is largest among the required numbers of times the consistent documents are to be circulated for decurling.

SUMMARY OF THE INVENTION

Taking into consideration the above circumstances, it is an object of the present invention to provide a printing apparatus capable of performing a decurling process through a circulation route without compromising the productivity of printing by determining the number of circulations in accordance with the print coverage of each print sheet to minimize the number of circulations and avoid the overall print process time from being elongated.

In order to accomplish the object as described above, the printing apparatus of the present invention forms images on a print sheet by an image forming unit, and comprises: a transportation route including an ordinary transportation route through which a print sheet can be transported through the image forming unit and discharged through a discharge route, and a circulation transportation route which is connected to the ordinary transportation route as a branch and operable to receive the print sheet from the ordinary transportation route and return the print sheet to the ordinary transportation route in order that the transportation route is configured as an annular route around which the print sheet can be circulated a plural number of times; a print coverage detecting unit operable to calculate the print coverage of an image to be printed on the print sheet by analyzing a characteristic of the image including at least one of the amount and density of ink to be ejected for forming the image on the print sheet by the image forming unit; a circulation repeat number determination unit operable to determine the number of circulations for the print sheet in accordance with the print coverage calculated by the print coverage detecting unit; a paper discharge control unit operable to transfer the print sheet transported on the transportation route to the discharge route with a timing in accordance with the number of circulations determined by the circulation repeat number determination unit; a sheet interval detecting unit operable to detect the interval between print sheets transported on the transportation route; and a paper feed control unit operable to feed print sheets to the transportation route in the order of printing in accordance with the interval between print sheets detected by the sheet interval detecting unit.

In accordance with the present invention as described above, it is possible to avoid unnecessary circulation of print sheets which need not be decurled and prevent the overall print process time from being elongated by detecting the print coverage on the basis of the amount and/or density of ink to be ejected, and circulating each print sheet a number of times which is determined in accordance with the print coverage of the each print sheet. In addition to this, since the paper feed control unit can successively feed a print sheet each time a paper interval is detected, the paper feeding operation can be started even if all the document data of a job is not completely provided.

Preferably, in the invention as described above, the printing apparatus further comprises a dry state detecting unit operable to detect the dry state of the print sheet transported on the transportation route, wherein the circulation repeat number determination unit changes the number of circulations for the print sheet in accordance with the detection result of the dry state detecting unit, wherein the paper discharge control unit transfers the print sheet transported on the transportation route to the discharge route in accordance with the number of circulations which is changed by the circulation repeat number determination unit, wherein the sheet interval detecting unit recalculates the interval between print sheets in accordance with the number of circulations which is changed by the circulation repeat number determination unit, and wherein the paper feed control unit feeds print sheets to the transportation route in accordance with the interval between print sheets in accordance with the interval between print sheets as recalculated by the sheet interval detecting unit. In this case, the printing time can be further reduced by discharging the print sheet which is dried earlier than scheduled, and advancing the time of feeding the next print sheet in correspondence with the earlier discharge.

Preferably, in the invention as described above, the circulation transportation route includes a sheet reversing route which is connected to the ordinary transportation route as a branch and operable to receive the print sheet from the ordinary transportation route, reciprocate the print sheet and return the print sheet to the ordinary transportation route in order to reverse the print sheet upside down, and wherein the paper discharge control unit and the paper feed control unit also controls the reversing operation of the print sheet and the speed and timing relating to the image formation on the back side of the print sheet after the reversing operation. In this case, it is possible to improve the productivity in the double-side printing mode and effectively perform the decurling process by the scheduling in which the print sheet reversed upside down through the sheet reversing route is inserted between print sheets to be printed on the main sides to concurrently perform the print process on the main side and the print process on the back side.

Preferably, in the invention as described above, the paper feed control unit feeds print sheets such that the interval between a preceding print sheet being transported and a subsequent print sheet just fed after the preceding print sheet is no shorter than a predetermined minimum interval plus the distance corresponding to the time required for reversing the subsequent print sheet if the subsequent print sheet is scheduled to be reversed. In this case, if the circulation route is provided with a sheet reversing route, a bypass route (which does not reverse a print sheet) and a switching mechanism for switching therebetween, the differential transportation time between the sheet reversing route and the bypass route can be absorbed.

Preferably, in the invention as described above, when the print sheet transported on the transportation route arrives at the junction point between the paper discharge route and the sheet reversing route, the paper discharge control unit judges the consistency in regard to the paper discharging order, the number of circulations and the main and back sides of the print sheet, and controls the switching operation between the sheet reversing route and the ordinary transportation route (paper discharge route) on the basis of this result of the judgment. In this case, since each print sheet is selectively discharged or circulated again on the basis of not only the number of circulations but also the consistency of main and back sides, it is therefore possible to make appropriate the number of circulations without compromising the productivity in the double-side printing mode.

Preferably, in the invention as described above, the printing apparatus further comprises a time schedule generation unit operable to generate a time schedule in which are described the speeds, orders and timings of feeding, image forming and transportation of the print sheets to be printed in accordance with the number of circulations determined by the circulation repeat number determination unit, wherein the paper discharge control unit and the paper feed control unit control the driving operations of the circulation transportation route and the ordinary transportation route, the switching operation between the circulation transportation route and the ordinary transportation route, and the speeds and timings of feeding, image forming and transportation of the print sheets in accordance with the time schedule. In this case, since the paper feeding requirements and paper discharging requirements can be provided as a time schedule in advance, it is possible to speed up the print process.

Meanwhile, feeding and discharging during transportation in accordance with the above time schedule is controlled by stopping the paper feeding operation after feeding a maximum number of print sheets which can be accommodated in the transportation route until a sufficient paper interval is detected, and resuming the operation of feeding the next print sheet after confirming the consistency in regard to the main/back side and discharging order of a print sheet which has been circulated the required number of times, discharging the print sheet, leaving a sufficient paper interval. In this case, each print sheet can be fed in consistency with the order of printing as intended, and discharged after the decurling process in consistency with the order of printing.

Preferably, in the invention as described above, the printing apparatus further comprises a dry state detecting unit operable to detect the dry state of the print sheet transported on the transportation route, wherein the time schedule generation unit performs regeneration of the time schedule in accordance with the detection result by the dry state detecting unit, and wherein the paper discharge control unit and the paper feed control unit control the driving operations of the circulation transportation route and the ordinary transportation route, the switching operation between the circulation transportation route and the ordinary transportation route, and the speeds and timings of feeding, image forming and transportation of the print sheets in accordance with the regenerated time schedule. In this case, the printing time can be further reduced by discharging the print sheet which is dried earlier than scheduled, and advancing the time of feeding the next print sheet in correspondence with the earlier discharge, and it is possible to always make use of appropriate paper feeding requirements and paper discharging requirements by generating the time schedule again when advancing the time of feeding and discharging, and speed up the print process.

As has been discussed above, in accordance with the present invention, it is possible to provide a printing apparatus capable of performing a decurling process through a circulation route without compromising the productivity of printing by determining the number of circulations in accordance with the print coverage of each print sheet to minimize the number of circulations and avoid the overall print process time from being elongated.

BRIEF DESCRIPTION OF THE DRAWINGS

The objects and features of the present invention will become more apparent from consideration of the following detailed description taken in conjunction with the accompanying drawings in which:

FIG. 4A is a flow chart for showing the operation of the printing apparatus in accordance with the embodiment of the present invention, when performing the decurling process.

FIG. 4B is a flow chart of a subroutine showing the respective steps of the print control process in accordance with the embodiment of the present invention.

FIG. 8 is a flow chart for showing the operation of the printing apparatus in accordance with the modification example when performing the processes of feeding, printing, decurling and discharging print sheets.

DESCRIPTION OF THE PREFERRED EMBODIMENTS

Overall Configuration of Printing Apparatus

Figure 1:
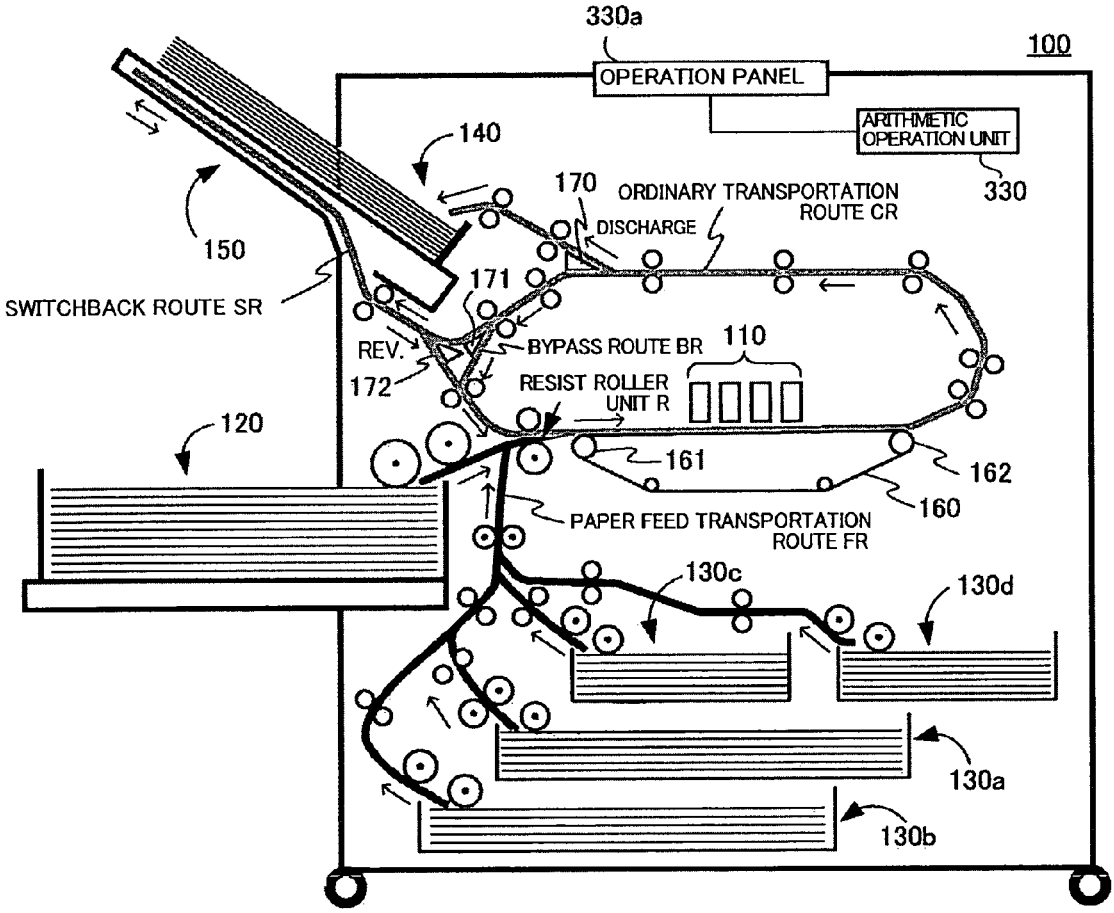
FIG. 1 is a schematic diagram for showing the configuration of a printing apparatus in accordance with an embodiment of the present invention.

An embodiment of the present invention will be explained with reference to the drawing. FIG. 1 is a schematic diagram for showing a print sheet transportation route of a printing apparatus 100 in accordance with the present embodiment.

In the case of the present embodiment, as shown in FIG. 1, the transportation route is annularly formed by a paper feed transportation route FR through which print sheets are fed, a paper discharge route through which print sheet are discharged, an ordinary transportation route CR which is extending from the paper feed transportation route to the paper discharge route, and a circulation route (bypass route BR) connected to the ordinary transportation route CR as a branch for receiving a print sheet from the ordinary transportation route CR and returning the print sheet to the ordinary transportation route CR. Also, the transportation route is provided with a sheet reversing route (switchback route SR) which is connected to the ordinary transportation route CR as a branch for receiving a print sheet from the ordinary transportation route CR, moving the print sheet backwards and forwards, and returning the print sheet to the ordinary transportation route CR in order to reverse the print sheet.

The printing apparatus 100 is provided with a paper feed mechanism for feeding print sheets including a paper feed side tray 120 exposed from the side surface of the housing of the printing apparatus 100, a plurality of paper feed trays 130*a*, 130*b*, 130*c* and 130*d* which are located inside the housing. Furthermore, a discharge port 140 is provided as a discharge mechanism for discharging print sheets which have been printed.

In the case of the present embodiment, the printing apparatus 100 is a line color inkjet printer provided with a head unit 110 having a plurality of ink heads each of which is elongated in the width direction of the print sheet and provided with a number of nozzles. The respective ink heads eject black or color inks respectively in order to print images of the respective colors on a line-by-line basis to overlap each other.

A print sheet fed from either the paper feed side tray 120 or one of the paper feed trays 130 is transported along a paper feed transportation route FR by rollers or another transportation mechanism to a resist roller unit R which defines a reference position at which the leading edge of each print sheet is aligned. The head unit 110 is located in the downstream side of the paper transportation route as seen from the resist roller unit R. The print sheet is printed to form an image with ink ejected from the respective print heads on a line-by-line basis, while being transported at a predetermined speed which is determined in accordance with print options, on a conveyor belt 160 which is located on the opposite side to the print heads 110.

The print sheet which has been printed is transported in the housing by the transportation mechanism such as rollers. In the case of the one-side printing process for printing only one side of the print sheet, the print sheet is transferred to the discharge port 140 and stacked on a catch tray 150 as a receiver at the discharge port 140 with the printed side down. The catch tray 150 is provided to protrude from the housing with a certain thickness. The catch tray 150 is slanted with a lower upright wall at which print sheets discharged from the discharge port 140 are automatically aligned under their own weight.

In the case of the double-side printing process for printing both sides of the print sheet, the print sheet is not transferred to the discharge port 140 after printing the main side (the first printed side is called "main side", and the next printed side is called "back side" in this description), but is transported in the housing. Because of this, the printing apparatus 100 is provided with a shunt mechanism 170 for selectively switching the transfer route for printing on the back side.

This shunt mechanism 170 is a switching unit for selectively connecting either the switchback route SR as a branch or the discharge port 140 to the ordinary transportation route CR, and operated to switch the transportation of a print sheet on the ordinary transportation route CR to be forwarded to the sheet reversing route or discharged to the discharge port 140. When the shunt mechanism 170 switches the route to the switchback route SR, the print sheet is transferred to the switchback route SR and reversed by reciprocating in the switchback route SR and returning to the ordinary transportation route CR as a switchback operation.

Furthermore, the bypass route BR is provided in the downstream side of the shunt mechanism 170 such that a print sheet is selectively transferred from the ordinary transportation route CR to either the switchback route SR or the bypass route BR by a shunt mechanism 171. When the shunt mechanism 171 switches the route to the bypass route, the print sheet is transferred to the ordinary transportation route CR through the bypass route BR as it is without reversing. Because of this, the print sheet can be transported and circulated without reversing through the bypass route BR, and thereby the same side of the print sheet can be repeatedly passed through the head unit 110. On the other hand, the switchback route SR is provided with a shunt mechanism 172 which switches the route to reverse the print sheet received from the ordinary transportation route CR by reciprocating in the switchback route SR and returning to the ordinary transportation route CR.

The print sheet passed through either the switchback route SR or the bypass route BR is then transferred to the resist roller unit R again, and printed on the back side in the same manner as on the main side. After printing on the back side, the print sheet with both sides being printed is transferred to the discharge port 140, discharged there from and stacked on the catch tray 150 as a receiver at the discharge port 140.

Meanwhile, in the case of the present embodiment, the switchback operation is performed in the double-side print mode by the use of the space formed in the catch tray 150. The space formed in the catch tray 150 is designed such that the print sheet cannot be accessed externally during the switchback operation. By this configuration, it is avoided that a user extracts the print sheet during the switchback operation by mistake. On the other hand, since the catch tray 150 is indispensable for the printing apparatus 100, there is no need for a separate space, which would be particularly provided in the printing apparatus 100 for the switchback operation, while making use of the space formed in the catch tray 150 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

Figure 2:
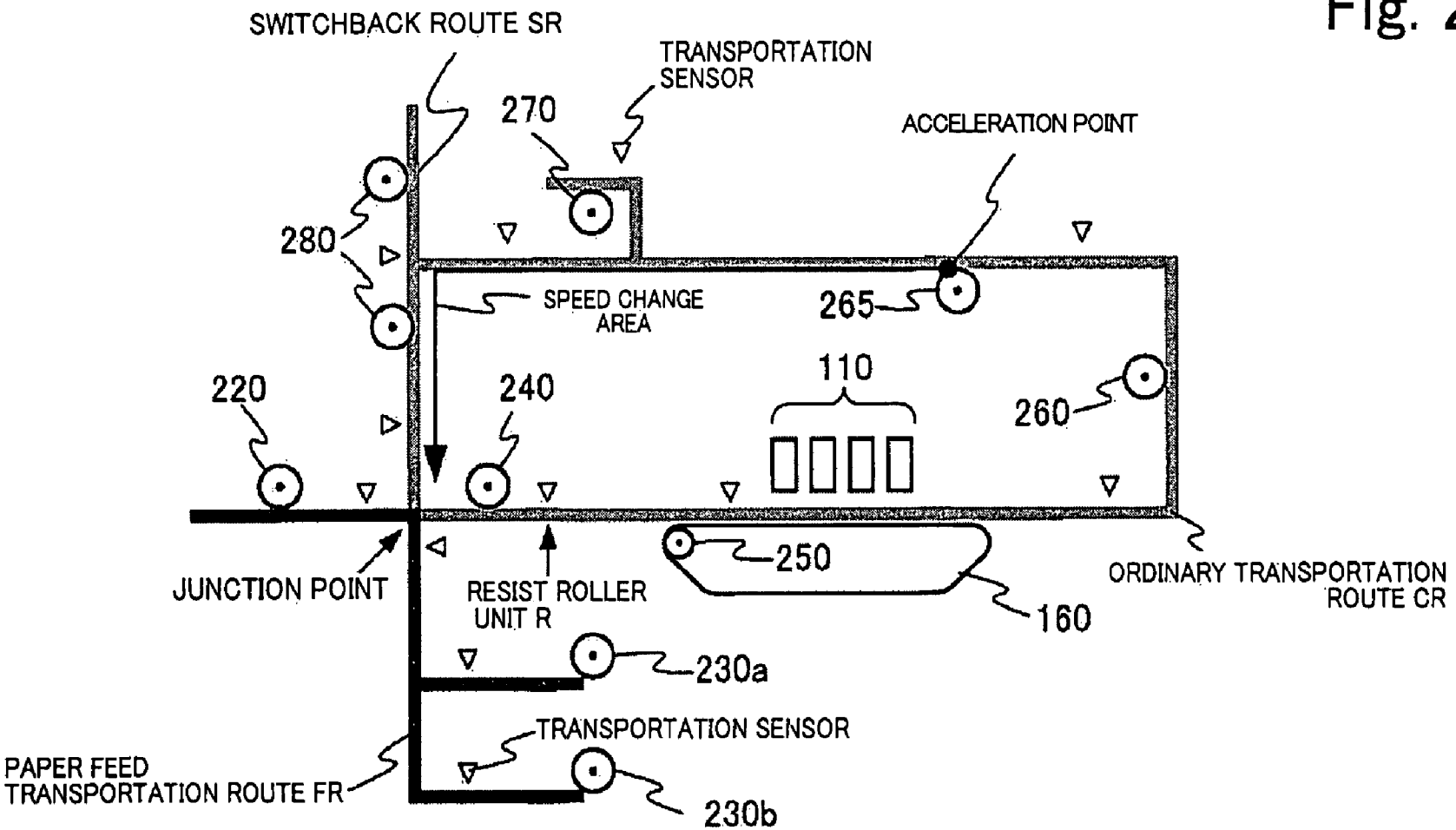
FIG. 2 is a diagram for schematically showing the respective transportation routes of the printing apparatus in accordance with the embodiment of the present invention.

In the double-side print mode of the printing apparatus 100, the print sheet is transferred to the resist roller unit R, which defines the reference position at which the leading edge of the print sheet is aligned, not only before printing the main side thereof but also before printing the back side. Because of this, just before the resist roller unit R, there is a junction point between the transportation route for transporting the print sheet just fed from the paper feed side tray and the transportation route for transporting the print sheet with the main side having been printed. FIG. 2 is a diagram for schematically showing the respective transportation routes such as the paper feed transportation route FR, the ordinary transportation route CR, and the switchback route SR. In the same figure, some of roller units forming the transportation mechanism are not illustrated for the sake of clarity in explanation.

The paper feed transportation route FR is provided with a side paper feed drive unit 220 for feeding paper from the paper feed side tray 120, and a first tray drive unit 230*a*, a second tray drive unit 230*b*, . . . respectively for feeding paper from the paper feed trays 130*a*, 130*b*, 130*c* and 130*d*. Each drive unit is provided with a transportation mechanism constructed by a plurality of rollers to extract print sheets one after another from the paper feed tray corresponding thereto and transfer the print sheets to the resist roller unit R. The respective transportation units can be driven independently from each other, and perform necessary operation in order to implement the paper feed mechanism.

In addition, the paper feed transportation route FR is provided with a plurality of transportation sensors with which paper jam can be detected along the paper feed transportation route FR. Each transportation sensor is a sensor which can determine if a print sheet is present and detect the leading edge of the print sheet. For example, the plurality of transportation sensors are located in appropriate positions of the paper feed transportation route at appropriate intervals such that paper jam can be detected if the transportation sensor located on the transportation side does not detect the print sheet a predetermined time after the transportation sensor located on the paper feeding side detects the print sheet.

Furthermore, paper jam (paper feeding error) can also be detected if the transportation sensor located near the paper feed tray does not detect the print sheet a predetermined time after starting driving the side paper feed drive unit 220, the first tray drive unit 230*a* or the like. By providing the transportation sensor near each paper feed tray, it is possible to determine whether or not paper jam occurs in the paper feed transportation route FR, and determine in what location of the paper feed transportation route FR the paper jam occurs.

Also, an image is formed on the upper surface of the print sheet that is transported on the ordinary transportation route CR. In the case of the present embodiment, a print sheet to be printed on both the opposite sides or to be decurled is transported and circulated in the ordinary transportation route CR through the switchback route SR or the bypass route BR to be repeatedly passed through the head unit 110.

The ordinary transportation route CR is provided with a resist drive unit 240 for leading a print sheet to the resist roller unit R, a belt drive unit 250 for driving the conveyor belt 160 which is located in a position opposite the head unit 110, first and second upper side transportation drive units 260 and 265 which are arranged on the ordinary transportation route CR successively in the paper transportation direction, an upper side paper discharge drive unit 270 for transferring a printed sheet to the discharge port 140, and a switchback route drive unit 280 for drawing the printed sheet in the switchback route SR, reversing and transferring the printed sheet to the junction point between the ordinary transportation route CR and the paper feed transportation route FR. Each of these transportation units is provided with a driving mechanism comprising one or more roller units, and serves to transport print sheets one after another along the transportation route. The respective transportation units can be driven independently from each other, and perform necessary operation in accordance with the transportation position of the print sheet.

The ordinary transportation route CR is also provided with a plurality of transportation sensors with which paper jam can be detected along the ordinary transportation route CR. Furthermore, it can be confirmed that each print sheet is transferred to the resist roller unit R in an appropriate manner. By providing the transportation sensor near each driving unit in the ordinary transportation route CR, it is possible to determine which drive unit has caused the paper jam along the ordinary transportation route CR.

The switchback route SR can transport a print sheet at a different speed than the ordinary transportation route CR, accelerate or decelerate the print sheet which is transferred from the ordinary transportation route CR, and shorten or extend the hold time during switchback operation.

Furthermore, in the case of the present embodiment, the print process can be successively performed at predetermined intervals by feeding a print sheet, and feeding a next print sheet in advance of printing and discharging the preceding print sheet, rather than feeding a print sheet, waiting for discharging this print sheet, and then feeding a next print sheet.

Figure 5A:
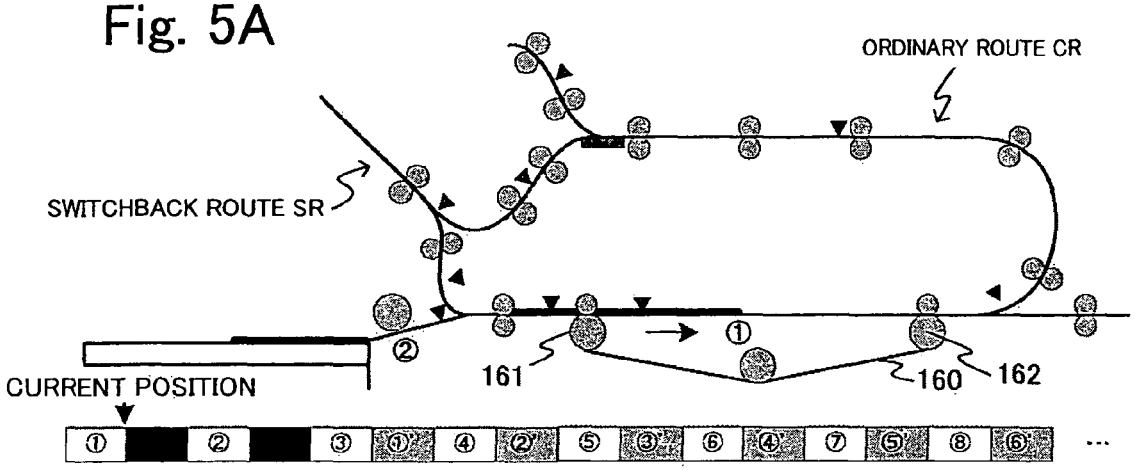
FIGS. 5A through 5C are explanatory views for showing the basic process of printing images in accordance with the scheduling of the embodiment of the present invention.
Figure 5B:
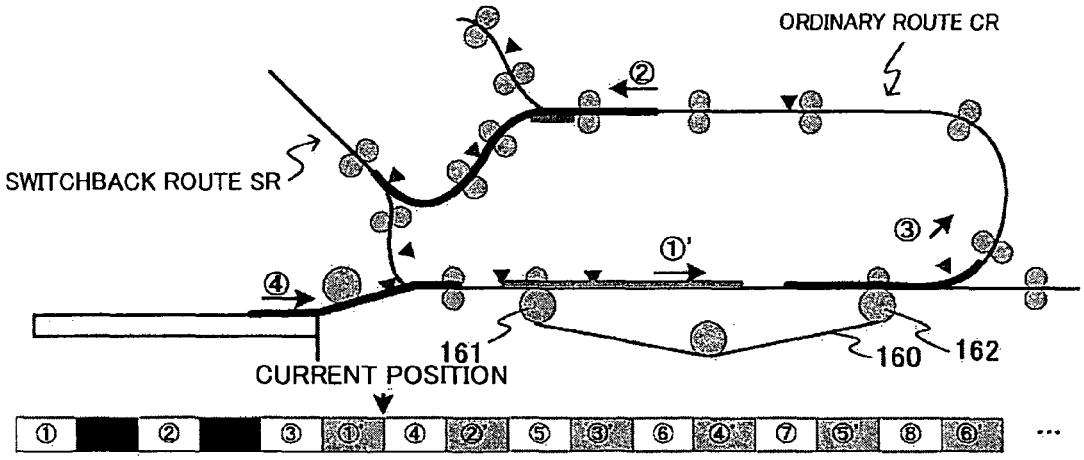
Figure 5C:
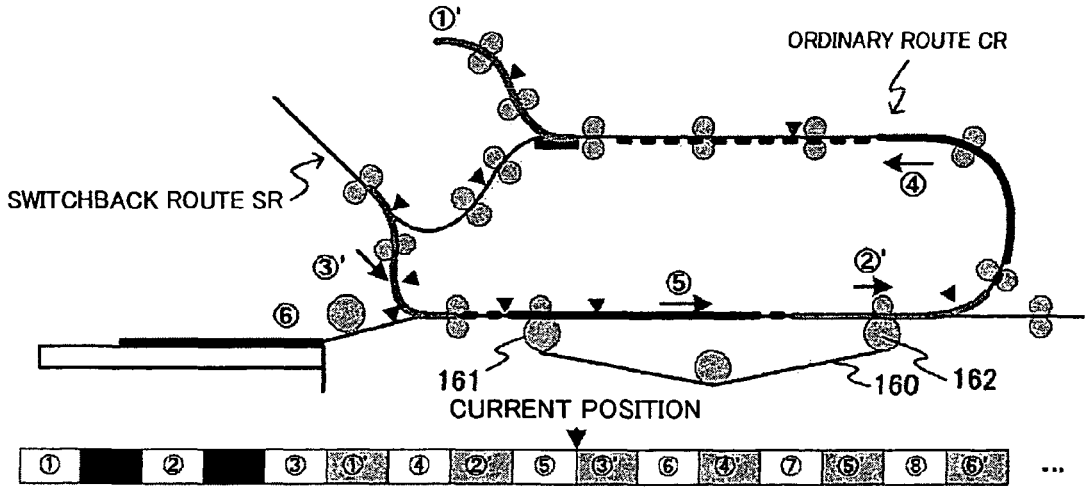

More specifically speaking, in the case of the ordinary double-side printing process of this embodiment, as illustrated in FIGS. 5A through 5C, a print sheet is printed on its main side by the head unit 110 (FIG. 5A), circulated by the ordinary transportation route CR, reversed upside down through the switchback route SR, returned to the head unit 110 (FIG. 5B), printed on its back side, and discharged (FIG. 5C). In this double-side printing process, as illustrated in FIG. 5B, the print sheet ①' reversed upside down through the switchback route SR is inserted between the print sheet ③ and the print sheet ④ which are to be printed on their main sides.

Accordingly, in the double-side printing process, a print sheet to be printed its main side is fed in order that a space is provided in front of this print sheet for giving way to the print sheet returned from the switchback route SR. By this space, in accordance with the present embodiment, it is possible to successively perform the print process on main sides and the print process on back sides and secure a ½ productivity as compared with one-side printing.

The conveyor belt 160 is located between and running around a driving roller 161 and a driven roller 162 located in a position opposite the head unit 110, and rotates about them in the clockwise direction as seen in the figure. Alternatively, decurling can be accelerated by opening a number of pores through this transfer belt 160 and generating a negative pressure in the back side of the transfer belt 160 to attract the print sheet, which is transported on the transfer belt 160, to the surface of the transfer belt 160.

The head unit 110 includes four ink heads of yellow (Y), magenta (M), cyan (C), and black (K) which are arranged over the upper surface of the conveyor belt 160 along the moving direction thereof, and located opposite the conveyor belt 160 to form a color image by superimposing four monochromatic images on the print sheet.

Furthermore, as shown in FIG. 1, the printing apparatus 100 is provided with an arithmetic operation unit 330. This arithmetic operation unit 330 is an arithmetic operation module composed of hardware elements, for example, processor (s) such as a CPU and a DSP (Digital Signal Processor), a memory, and other necessary electronic circuits, and software (and/or firmware) for implementing necessary functions in combination with the hardware. Several function modules can be virtually implemented by the software for performing the processes of handling image data, controlling the operations of the respective units, and performing a variety of processes in response to the manipulation by the user. In addition, this arithmetic operation unit 330 is connected to an operation panel 330*a*, through which the arithmetic operation unit 330 can receive commands and settings from the user.

Particularly, the printing apparatus 100 in accordance with the present embodiment is provided with the functionality of performing a decurling process by circulating each print sheet a number of times corresponding to the print coverage of this each print sheet through either the switchback route SR or the bypass route BR to dry the print sheet having been printed. Meanwhile, in the case of the present embodiment, when only one side of a print sheet is printed, the print sheet is circulated a predetermined number of times for decurling through the bypass route BR after the one side is printed. On the other hand, when both sides of a print sheet is printed, the print sheet is printed on the both sides by the use of the switchback route SR, and thereafter circulated a predetermined number of times for decurling through the bypass route BR. The print sheet is discharged after repeating the circulation the predetermined number of times.

(Decurling Process Control)

Figure 3:
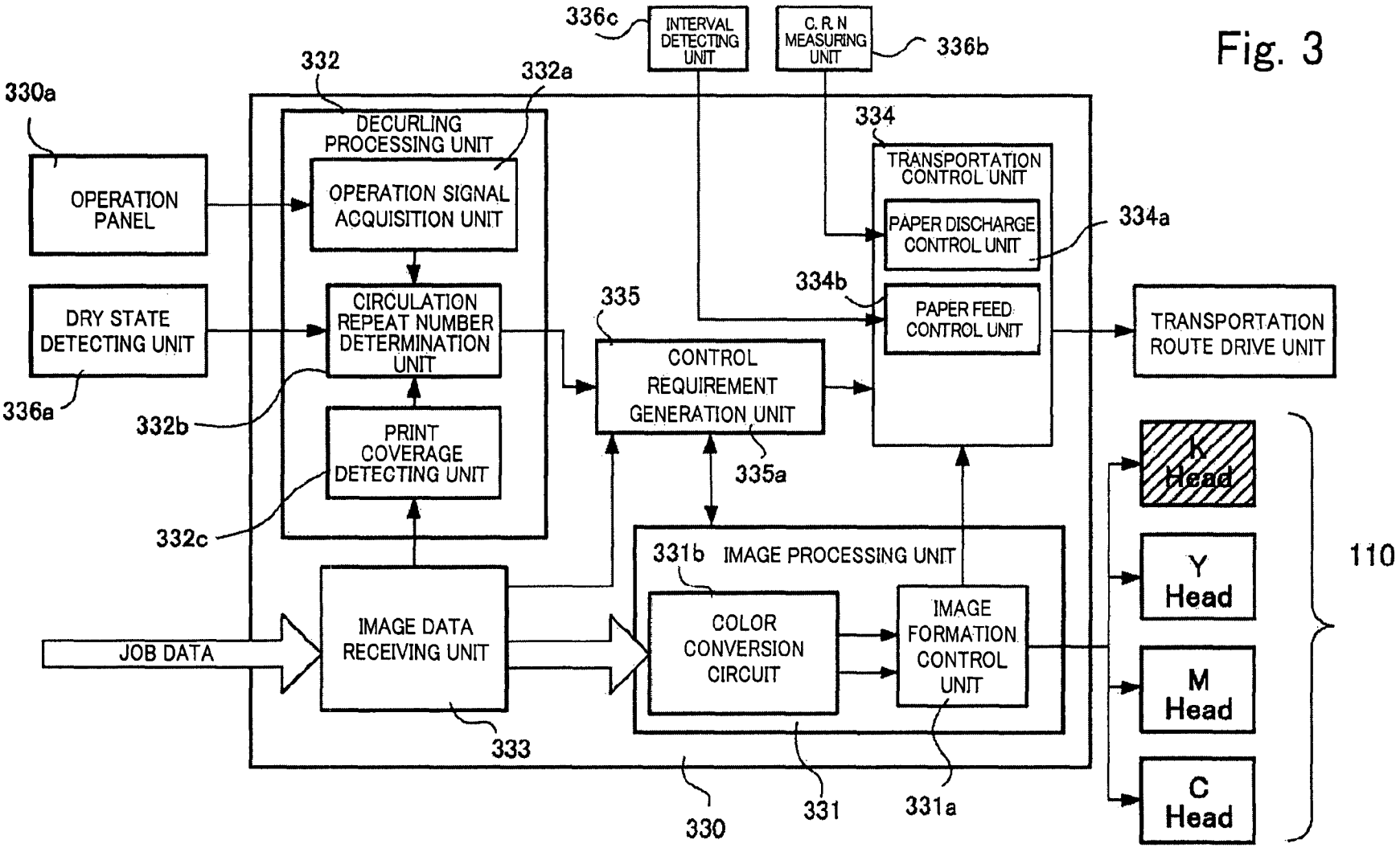
FIG. 3 is a block diagram showing function modules implemented within the arithmetic operation unit including a function module for performing the decurling process in accordance with the embodiment of the present invention.

The decurling process in accordance with the present invention is performed by the arithmetic operation unit 330 which analyzes image data and controls the operations of the head unit 110, the respective drive motors, and drive units such as switching devices for driving the transfer mechanism. FIG. 3 is a block diagram showing a function module implemented within the arithmetic operation unit 330 for performing the decurling process.

As shown in FIG. 3, the arithmetic operation unit 330 includes a decurling processing unit 332, an image data receiving unit 333, an image processing unit 331, a transportation control unit 334, and a control requirement generation unit 335.

The image data receiving unit 333 is a communication interface for receiving job data, and serves as a module for transferring image data contained in the received job data to the respective processing units 331, 332 and 335.

The image processing unit 331 is an arithmetic processing unit for performing digital signal processes specialized for processing images, and serves as a module for performing image conversion and other necessary processes and performing the image forming process. This image processing unit 331 is provided with an image formation control unit 331*a*, and a color conversion circuit 331*b*.

The color conversion circuit 331*b* is a circuit for converting an RGB print image into a CMYK print image, and the image formation control unit 331*a* performs a print process on the basis of the print images for the respective colors. The image formation control unit 331*a* is a module for controlling the overall image forming process by controlling the operations of the ink heads of the respective colors and the driving means along the transportation route, and performing the image forming process at the speeds and with timings on the basis of the timings and printing speeds scheduled by the control requirement generation unit 335.

On the other hand, the decurling processing unit 332 is provided with an operation signal acquisition unit 332*a*, a circulation repeat number determination unit 332*b*, and a print coverage detecting unit 332*c*.

The operation signal acquisition unit 332*a* is a module for receiving an operation signal from the user through the operation panel 330*a*, analyzing the operation signal as received, and performing the process corresponding to the user operation by other modules. Particularly, in the case of the present embodiment, the operation signal acquisition unit 332*a* is provided with the functionality relating to the image forming process, such as the functionality of receiving from the user a command instructing whether to perform the decurling process for preventing a curl from occurring, and a command indicative of an option, and outputting a signal indicative of whether to perform the decurling process to the circulation repeat number determination unit 332*b*.

The print coverage detecting unit 332*c* is a module for calculating the print coverages of the respective print sheets, analyzes the image characteristics including either the amount of ink to be ejected or the density of ink in correspondence with the image data contained in the job data received by the image data receiving unit 333 to detect the print coverages and distributions of the respective colors, followed by outputting the detection result. In addition to this, when there are a plurality of document sheets in a print job which is a unit of print process, this print coverage detecting unit 332*c* opens and analyzes the images of all the document sheets of the job, selects document sheets which seem to be curled from among the document sheets of the job, and outputs the selection information to the control requirement generation unit 335 together with the image characteristics of the selected document sheets. Incidentally, the print coverage may be calculated by dividing each image into a plurality of areas and separately calculating and evaluating each area, such that document sheets which seem to be curled can be determined on the basis of the largest print coverage or worst condition of the areas (for example, the most overcrowding area etc.) of each document sheet.

The circulation repeat number determination unit 332*b* determines, for each print sheet, if a curl is likely to be induced therein, and determines the number of circulations for each print sheet. The number of circulations determined by the circulation repeat number determination unit 332*b* is input to the control requirement generation unit 335. The circulation repeat number determination unit 332*b* performs the circulation repeat number determination process by acquiring information about the image characteristics such as print coverages from the print coverage detecting unit 332*c*, comparing the print coverages with a threshold value, determining in which print sheet a curl is likely to be induced in accordance with whether or not the print coverage is greater than the threshold value, and outputting the number of circulations calculated in accordance with the determination to the control requirement generation unit 335.

Particularly, in the case of the present embodiment, the circulation repeat number determination unit 332*b* is connected to a dry state detecting unit 336*a* for detecting the dry state of a print sheet transported on the transportation route, and capable of adjusting the determined number of circulations and rescheduling subsequent procedures (paper feeding, discharging and so forth). This dry state detecting unit 336*a* can be implemented with any appropriate mechanism capable of measuring the moisture content of a print sheet such as a humidity sensor, a transparency sensor or the like.

Incidentally, the circulation repeat number determination unit 332*b* may be connected to a temperature sensor, a humidity sensor and/or the like for measuring the ambient temperature and/or the ambient humidity, in order to modify the threshold value to be compared with the print coverage for analysis with reference to the temperature and/or the humidity detected by the sensors.

When the operation signal acquisition unit 332*a* has received an operation signal indicating that the decurling process is not to be performed, the circulation repeat number determination unit 332*b* does not increase the number of circulations for the decurling process, but outputs the number of circulations as conventionally determined.

The control requirement generation unit 335 is a module for generating control requirements in accordance with which the respective print sheets are fed and discharged. More specifically described, the control requirement generation unit 335 determines the speeds, orders and timings of re-feeding, image forming and transportation of the print sheets to be printed on the main side and the print sheets reversed through the sheet reversing route in order to transport the respective print sheets in accordance with the time schedule as shown in FIG. 6, and generates the control requirements for realizing the process as scheduled. In the case of the present embodiment, the control requirement generation unit 335 determines the speeds, orders and timings of feeding, image forming and transportation of the print sheets to be printed in accordance with the number of circulations required for decurling which is determined by the circulation repeat number determination unit 332*b*, and generates the control requirements relating to feeding and discharging as described above.

Figure 6A:
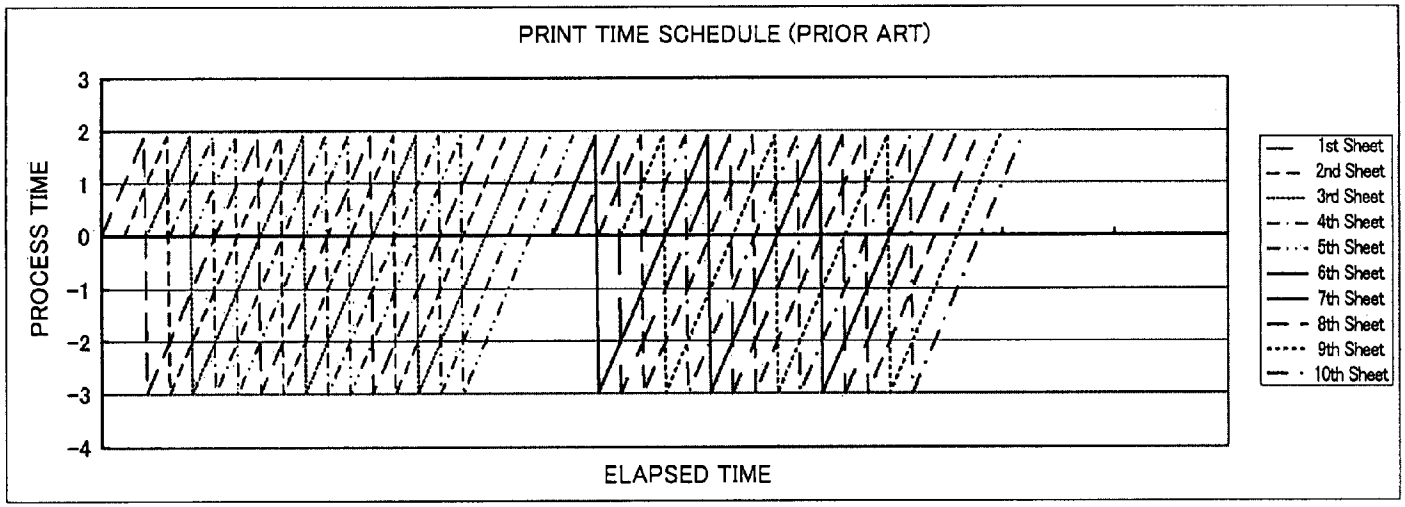
FIG. 6A is a diagram showing the time schedule of the transportation of print sheets in the print sheet transportation route in accordance with prior art.
Figure 6B:
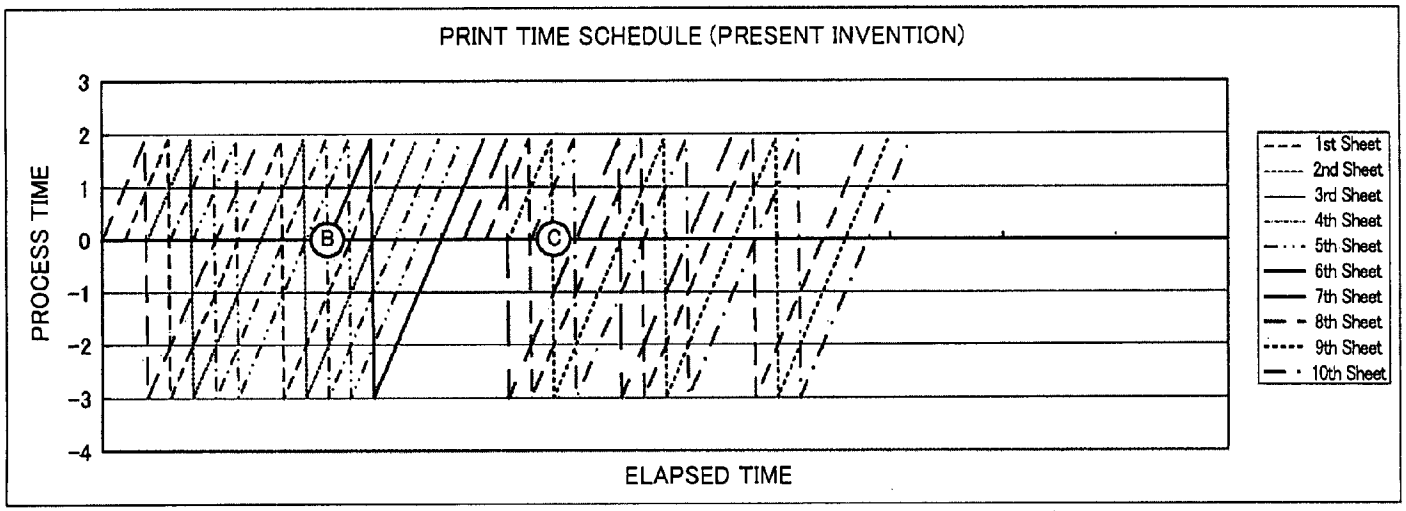
FIG. 6B is a diagram showing the time schedule of the transportation of print sheets in the print sheet transportation route in accordance with the embodiment of the present invention.

Meanwhile, feeding and discharging during transportation in accordance with the above time schedule is controlled by monitoring feeding and discharging conditions on a real time base. For example, feeding operation is stopped after feeding a maximum number of print sheets which can be accommodated in the transportation route, and started after discharging a print sheet which has been circulated the required number of times to insert the next print sheet into a sufficient space formed after discharging the print sheet. Namely, when a print sheet has been circulated the number of times required for decurling, the print sheet is immediately discharged by detecting this fact to leave an empty space which is then detected followed by referring to the feeding requirements and immediately feeding the next print sheet if the feeding requirements are satisfied. Because of this, when starting the print process, feeding paper can be started even if all the document data of a job is not completely provided. FIG. 6B is a diagram showing the time schedule of the transportation of print sheets in the print sheet transportation route in accordance with the present embodiment. FIG. 6A is a diagram showing the time schedule of the transportation of print sheets in the print sheet transportation route in accordance with the prior art as explained above.

In the diagram shown in FIG. 6B, the vertical axis represents elapsed time and the horizontal axis represents process time. Particularly, on the vertical axis, "0" indicates the process time of feeding paper. The process time increases from "0" to "2" in correspondence with transportation positions from the paper feeding position to the position just before the paper discharge route. The print process is performed at the process time "1". The print sheet which is being decurled is simply passed as it is without printing at the process time "1". In the one-side printing mode without decurling, the print sheet is discharged at the process time "2". Conversely, in the case where the decurling process is performed in the double-side printing mode, the print sheet is not discharged at the process time "2" (equivalent to "−3"), but transferred through the switchback route SR for reversing upside down, returned to the resist roller unit R, printed in the ordinary transportation route CR, and then circulated a predetermined times through the ordinary transportation route CR and the bypass route BR, followed by discharging at the process time "2".

In the case of this example, as illustrated in FIG. 6B, the number of circulations for the first print sheet is 1, and the numbers of circulations of the second through fifth print sheets are 2 respectively. The first print sheet is circulated one time and discharged at the process time "2" leaving an interval space, which is detected and used to insert the sixth print sheet which is fed at the process time "0" indicated with mark B in the same figure. On the other hand, as shown in FIG. 6B with mark C, even when an interval space is detected, the next print sheet is not fed just after the detection if the remaining number of circulations for another print sheet is larger than the number of circulations for the next print sheet. In such a case, the next print sheet is fed after the remaining number of circulations for any other print sheet becomes not greater than the number of circulations for the next print sheet.

The transportation control unit 334 is a module for controlling the transportation operations of the ordinary transportation route CR and the switchback route SR and the operation of the shunt mechanism 170 in accordance with the scheduling generated by the control requirement generation unit 335. This transportation control unit 334 includes a paper discharge control unit 334*a* for transporting a print sheet located in the ordinary transportation route CR to the paper discharge route in accordance with the number of circulations which is determined by the circulation repeat number determination unit 332*b*, and a paper feed control unit 334*b* for feeding print sheets to the ordinary transportation route CR in the order of printing in accordance with the interval between print sheets detected by the sheet interval detecting unit 336*c*. When a print sheet transported in the transportation route arrives at the junction point between the paper discharge route and the sheet reversing route, the paper discharge control unit 334*a* of the present embodiment determines the paper discharging order, the number of circulations and the consistency of print sheets in regard to the main and back sides, and controls the switching operation between the sheet reversing route and the ordinary transportation route (paper discharge route) on the basis of this result of determination. More specifically speaking, the consistency is judged in regard to whether the print sheets are discharged in the order of page numbers or any other predetermined order, whether each print sheet is circulated at least a predetermined number of times required for decurling, and whether each print sheet is discharged either face-up or face-down as predetermined.

In the case of the present embodiment, the transportation control unit 334 includes the sheet interval detecting unit 336*c* for detecting the interval between adjacent sheets transported on the transportation route. This sheet interval detecting unit 336*c* detects whether or not there is a print sheet transported on the transportation by an appropriate sensor, detects a sheet interval (empty space) on the transportation with reference to the transportation speed and the transit time of the print sheet, and determines whether or not the next print sheet can be inserted there between. The above mentioned transportation sensors can be used for this purpose. Also, the transportation control unit 334 is connected to a circulation repeat number measuring unit 336*b* which counts the number of print sheets and the number of circulations for each print sheet on the transportation route. The paper discharge control unit 334*a* performs discharging a print sheet with the timing determined in accordance with the measurement result by the circulation repeat number measuring unit 336*b*. Meanwhile, the sheet interval detecting unit 336*c* and the circulation repeat number measuring unit 336*b* operates independently from each other, and the paper feeding process and the paper discharging process are performed independently from each other.

(Decurling Process)

The decurling process can be performed by operating the printing apparatus having the structure as described above as follows. FIG. 4A is a flow chart for showing the operation of the printing apparatus in accordance with the present embodiment when performing the decurling process.

First, when job data is received and image data is acquired, the image data is handled by the image processing unit 331 and color converted by the color conversion circuit 331*b*, and the print coverage of the print image corresponding to the image data is calculated in step S101. The print coverage is evaluated in a stepwise manner by comparing with threshold values. Namely, the print coverage is evaluated as one of a plurality of print coverage levels, for example, low level, medium level and high level, or level 1, level 2, . . . and level 5. The number of circulations for each print sheet is determined in accordance with the evaluation of the print coverage, followed by generating control requirements required for operations in conformity with the time schedule which is determined in accordance with the number of circulations for each print sheet in step S102. These threshold values are changed when necessary in accordance with the degree of dryness (humidity, transparency or the like) of print sheets which is acquired by the dry state detecting unit 336*a*.

However, if the print coverage does not exceed a predetermined threshold value when the time schedule is generated in step S102, conventional transportation scheduling is employed as illustrated in FIG. 5, such that each print sheet is circulated a number of times required when the decurling process is not performed. On the other hand, when the print coverage exceeds the predetermined threshold value, the transportation schedule is provided for performing the decurling process as shown in FIG. 6B. The print process is then started such that the paper feeding process (steps S103 to S107) and the paper discharging process (steps S108 to S113) are controlled independently from each other.

The paper feeding process is controlled on the basis of the control requirements in accordance with the time schedule as described above to start feeding the next print sheet in step S103 in order to insert the next print sheet into the paper interval detected by the sheet interval detecting unit 336*c* with the timing as shown in FIG. 6B.

For example, the paper feed control unit 334*b* feeds print sheets such that the interval between a preceding print sheet being transported and a print sheet just fed after the preceding print sheet is no shorter than a predetermined minimum interval plus the distance corresponding to the time required for reversing a print sheet, if the subsequent print sheet is scheduled to be reversed. Thereafter, until all the print sheets have been fed (i.e., the "N" branch from step S105), it is successively monitored whether or not there is a paper interval in step S104, and the feeding process is halted if there is no paper interval (i.e., the "N" branch from step S106) to repeat a loop process.

When a paper interval is detected as shown in FIG. 6B with mark B (i.e., the "Y" branch from step S106), a print sheet is immediately fed. The process in the steps S103 through S106 is repeated until all the print sheets are fed.

Each print sheet is printed by the print process control as described below. FIG. 4B is a flow chart of a subroutine showing the respective steps of the print control process in step S107. Incidentally, in this print control process, it is determined whether to perform a print process for each print sheet on the basis of whether the each print sheet is circulated for printing or decurling. If circulated for printing, both the print operation to be described below and the switching operation between the switchback route SR and the bypass route BR are performed to support straight discharging in the one-side printing mode and reversing discharging in the double-side printing mode.

More specifically described, print scheduling (print control requirements) is determined in accordance with whether or not print sheets are discharged straight or reversed and whether or not document sheets are placed face up or face down.

The print control requirements are determined in accordance with which of the main side and the back side is to be printed first, with what timing the print sheet is to be reversed, and in which circulation what image is to be printed.

As a result, monitoring the control requirements of the paper discharging process is performed in regard to whether or not the process of printing the main side has been completed, whether or not the process of printing the back side has been completed, whether or not the print sheet has been dried (whether or not the predetermined number of circulations have been completed), how many times the print sheet has been circulated up to the present time. Examples of the control requirements are shown in the following tables.

Table 1 shows the order of discharge and the side corresponding to side A. Incidentally, in the above table, the order of discharge is described in terms of arrangement of document sheets and represents the order in which print sheets are discharged, i.e., the first print sheet, the second print sheet, the third print sheet, . . . , and the N-th print sheet. In other words, if original images are assigned to print sheets respectively from the original image of the smallest page of the document in ascending order of page numbers, i.e., the first document sheet, the second document sheet, the third document sheet, . . . , and the N-th document sheet.

TABLE 1

| | | Order of Discharge | Side A |
|---|---|---|---|
| Face-Up | Straight Discharge | From N-th Document Sheet | Side Having Smaller Page Number of Print Sheet |
| | Reversing Discharge | From N-th Document Sheet | Side Having Larger Page Number of Print Sheet |
| Face-Down | Straight Discharge | From 1st Document Sheet | Side Having Larger Page Number of Print Sheet |
| | Reversing Discharge | From 1st Document Sheet | Side Having Smaller Page Number of Print Sheet |

Table 2 shows the method of controlling the print process and the reversing process together with the required number of circulations for each side and whether to perform the print process, in correspondence with the number of circulations for each print sheet finally determined. Incidentally, in this description, side A represents the side facing the image forming unit when the print sheet is passing through the image forming unit just before discharging, irrespective of whether or not an image is formed. Side B represents the opposite side to side A of the print sheet. The required number of circulations for side A is referred to as "a", and the required number of circulations for side B is referred to as "b".

TABLE 2

| Number of Circulations for Each Side and Whether To Print | | | | | | |
|---|---|---|---|---|---|---|
| Side A | Side B | Number of Circulations | 1st Print Side | Switchback in 1st Circulation | 2nd Print Operation | Switchback in 2nd Circulation |
| No Print | No Print | 0 | None | None | None | None |
| a (a >= 0: Print) | No Print | a | Side A | None | None | None |
| a | b (a > b a >= 2) | a | Side A | Viable | Side B | Viable |
| 1 | 0(Forming Image) | 2 | Side B | Viable | Side A | None |
| | | 2 | Side A | Viable | Side B | Viable |
| No Print | b (b >= 1) | b | Side B | Viable | None | None |
| No Print | 0 (Forming Image) | 1 | Side B | Viable | None | None |
| a | b (a < b b >= 1) | b | Side B | Viable | Side A | Viable |
| a (a >= 0: Print) | b (a = b) | a + 1, b + 1 | Side B | Viable | Side A | None |

Table 3 shows the number of circulations for a print sheet in correspondence with the number of circulations for side A and the number of circulations for side B, together with which of side A and side B is to be printed first as determined on the basis of the correspondence. Incidentally, if a=1 and b=0 as shown with mark *1 in Table 3, either side A or side B can be printed first.

TABLE 3

| | | b | | | |
|---|---|---|---|---|---|
| | | NO PRINT | 0 | 1 | 2 OR MORE |
| a | NO PRINT | 0 | 1 (b + 1) | 1 (b) | b |
| | 0 | 0 (a) | 1 (a + 1, b + 1) | 1 (b) | b |
| | 1 | 1 (a) | 2 (a + 1, b + 2) *1 | 2 (a + 1, b + 1) | b |
| | 2 OR MORE | a | a | a | If a ≠ b, larger one of a and b If a = b, a + 1 or b + 1 |

Side A is printed first
Side B is printed first
*Either side can be printed first The print process and the circulating transportation process are controlled as shown in FIG. 4B on the basis of the aforementioned print control requirements. Namely, it is determined whether to print the print sheet which is fed in step S1071. If the print sheet is to be printed (i.e., the "Y" branch from step S1071), the corresponding page is printed on the print sheet by the image forming unit. If the print sheet need not be printed (i.e., the "N" branch from step S1071), the print process is skipped.

Then, the print sheet is passed through the image forming unit, and it is determined whether to perform the switchback operation for the print sheet being transported toward the discharge mechanism in step S1073. If only one side has been printed but the other side has not been printed yet in the double-side printing mode, the switchback operation is needed (i.e., the "Y" branch from step S1073), and the circulating transportation is performed through the switchback route SR in step S1074. Conversely, if the switchback operation is not needed (i.e., the "N" branch from step S1073), i.e., if the required print process has been completed for the print sheet, the circulating transportation is performed through the bypass route BR in step S1075. With respect to the print sheet on which the required print process has been completed (i.e., the "Y" branch from step S1076), the subroutine is finished followed by proceeding to step S108 of FIG. 4A from which the decurling process is performed.

Next, the discharge control process is performed for each print sheet, on which the required print process has been completed, in accordance with the necessity of decurling. In this discharge control process, the number of circulations for each print sheet is counted by the circulation repeat number measuring unit 336*b*, and the degree of dryness is measured by the dry state detecting unit 336*a* on the basis of the discharge control requirements in step S108. When the number of circulations scheduled in the time schedule are performed (i.e., the "Y" branch from step S109), the consistency of discharging print sheets is judged in step S110. However, even when the scheduled number of circulations have not been performed yet, the process proceeds from step S109 to step S110, in which the consistency of discharging print sheets is judged, if the sufficient dryness of the print sheet is detected (i.e., the "Y" branch from step S109). Conversely, if the sufficient dryness of the print sheet is not detected while the scheduled number of circulations have not been performed yet (i.e., the "N" branch from step S109), the circulation is repeated in step S112 on the basis of the control requirements in accordance with the time schedule. This repeated circulation is performed to provide a drying time for decurling and adjust the consistency of discharging print sheets.

If the consistency is confirmed to be adequate (i.e., the "Y" branch from step S110), the print sheet is discharged in step Sill. If the consistency is not confirmed (i.e., the "N" branch from step S110), the circulation is repeated in step S112 until the consistency is confirmed. After circulating all the print sheets the necessary numbers of times (i.e., the "Y" branch from step S113), the print process is completed.

(Actions and Effects)

In accordance with the present embodiment as has been discussed above, it is possible to avoid unnecessary circulation of print sheets which need not be decurled and prevent the overall print process time from being elongated by detecting the print coverage on the basis of the amount and/or density of ink to be ejected, and circulating each print sheet a number of times which is determined in accordance with the print coverage of the each print sheet. Namely, the print process of the present embodiment can be completed earlier than the print process of prior art as understood from the comparison between the conventional time schedule of FIG. 6A in which the number of circulations is uniquely applied to a plurality of print sheets which are concurrently transported in the transportation route and the time schedule of FIG. 6B in which the next print sheet is fed when an paper interval is detected in accordance with the present invention.

Also, in the case of the present embodiment, since the dry state detecting unit 336*a* is provided for detecting the dry state of a print sheet transported in the transportation route, the printing time can be further reduced by discharging the print sheet which is dried earlier than scheduled, and advancing the time of feeding the next print sheet in correspondence with the earlier discharge.

Furthermore, in the case of the present embodiment provided with the switchback route SR, since the paper discharge control unit 334*a* and the paper feed control unit 334*b* serve to control the print sheet reversing operation, and the speeds and timings relating to the image formation on the back side after the reversing operation, it is possible to improve the productivity in the double-side printing mode and effectively perform the decurling process by the scheduling in which the print sheet reversed upside down through the switchback route SR is inserted between print sheets to be printed on the main sides to concurrently perform the print process on the main side and the print process on the back side.

Furthermore, in the case of the present embodiment, when a print sheet transported in the transportation route arrives at the junction point between the paper discharge route and the sheet reversing route, the paper discharge control unit 334*a* judges the consistency in regard to the paper discharging order, the number of circulations and the main and back sides, and controls the switching operation between the sheet reversing route and the ordinary transportation route (paper discharge route) on the basis of this result of the judgment, such that each print sheet is selectively discharged or circulated again on the basis of not only the number of circulations but also the consistency of main and back sides. It is therefore possible to make appropriate the number of circulations without compromising the productivity in the double-side printing mode.

Furthermore, in the case of the present embodiment, the paper discharge control unit 334*a* and the paper feed control unit 334*b* serve to control the switching operation between the switchback route SR and the ordinary transportation route CR and the speeds and timings of feeding, image forming and transportation of the print sheets on the basis of the control requirements in accordance with the time schedule, and thereby it is possible to set up the paper feeding requirements and the paper discharging requirements in advance, and speed up the print process. Particularly, in the case of the present embodiment, it is possible to discharge the print sheet which is dried earlier than scheduled, and advance the time of feeding the print sheet in correspondence with the earlier discharge to reduce the printing time by generating the time schedule again on the basis of the detection result of the dry state detecting unit 336*a* and controlling the driving operations of the switchback route SR and the ordinary transportation route CR on the basis of the control requirements in accordance with the time schedule which is generated again, and it is possible to always make use of appropriate paper feeding requirements and paper discharging requirements by generating the time schedule again when advancing the time of feeding and discharging, and speed up the print process.

As has been discussed above, in accordance with the present embodiment applied to a printing apparatus such as an ink jet printer, it is possible to minimize the number of circulations, prevent the overall print process time from being elongated, and maintain the productivity by determining the number of circulations in accordance with the print coverage of each print sheet when the decurling process is performed by the use of the sheet reversing route.

Modified Example

Figure 7:
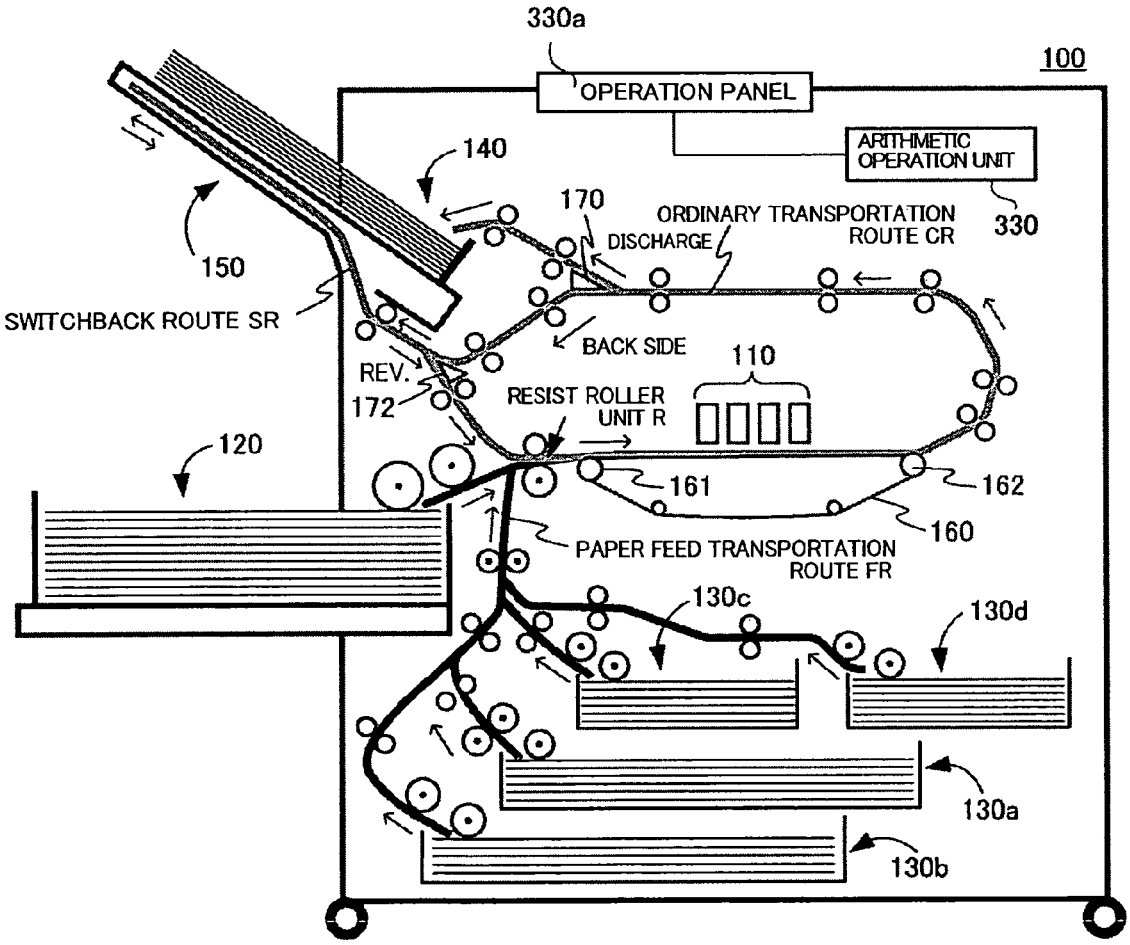
FIG. 7 is a schematic diagram for showing the configuration of a printing apparatus in accordance with a modification example of the present invention.

Next, a modification example of the present invention will be explained. FIG. 7 is a schematic diagram for showing the print sheet transportation route of a printing apparatus 100 in accordance with the modification example. Meanwhile, in the same figure, like reference numbers indicate functionally similar elements as the above embodiment unless otherwise specified, and therefore no redundant description is repeated.

This modification example is not provided with the bypass route BR of the printing apparatus 100 as described above, such that each print sheet is always reversed when repeating circulation.

More specifically speaking, as illustrated in FIG. 7, each print sheet is transferred, unless discharged, always from the ordinary transportation route CR to the switchback route SR in the printing apparatus in accordance with the present embodiment because the bypass route BR is not provided.

The operation of this modification example is controlled as follows. FIG. 8 is a flow chart for showing the operation of the printing apparatus in accordance with the present modification example when performing the decurling process.

First, when job data is received and image data is acquired, the image data is handled by the image processing unit 331 and color converted by the color conversion circuit 331*b*, and the print coverage of the print image corresponding to the image data is calculated in step S201. The print coverage is evaluated in a stepwise manner by comparing with threshold values. The number of circulations for each print sheet is determined in accordance with the evaluation of the print coverage, followed by generating control requirements in step S202.

However, under the requirements which is generated in step, if the print coverage does not exceed a predetermined threshold value, conventional transportation scheduling is used as illustrated in FIG. 5, such that each print sheet is circulated a number of times required when the decurling process is not performed. On the other hand, when the print coverage exceeds the predetermined threshold value, the transportation schedule is provided for performing the decurling process as shown in FIG. 6B. The print process is then started such that the paper feeding process (steps S203 to S206) and the paper discharging process (steps S207 to S214) are controlled independently from each other.

The paper feeding process is controlled on the basis of the control requirements (time schedule) as described above to start feeding the next print sheet in step S203 in order to insert the next print sheet into the paper interval detected by the sheet interval detecting unit 336*c* with the timing as shown in FIG. 6B. Thereafter, until all the print sheets have been fed (i.e., the "N" branch from step S205), it is successively monitored whether or not there is a paper interval in step S204, and the feeding process is halted if there is no paper interval (i.e., the "N" branch from step S206) to repeat a loop process.

When a paper interval is detected as shown in FIG. 6B with mark B (i.e., the "Y" branch from step S206), a print sheet is immediately fed. The process in the steps S203 through S206 is repeated until all the print sheets are fed.

Each print sheet is printed by the print process control as described below. In this modification example, it is determined in step S207 whether to perform a print process for each print sheet on the basis of whether the each print sheet is circulated for printing or decurling. If circulated for printing (i.e., the "Y" branch from step S207), the print process is performed first on the back side (side B) in step S208 and thereafter on the main side (side A) in step S209. Conversely, if circulated for decurling (i.e., the "N" branch from step S207), the print sheet is passed through the image forming unit without printing, and the process proceeds to step S210 in which it is monitored whether or not the discharge requirements are satisfied.

Next, the discharge control process is performed for each print sheet, on which the required print process has been completed, in accordance with the necessity of decurling. In this discharge control process, while monitoring the control requirements in step S210, it is determined in step S211 whether or not the discharge requirements are satisfied in accordance with the control requirements in step S211. More specifically speaking, the number of circulations for each print sheet is counted by the circulation repeat number measuring unit 336*b*, and the degree of dryness is measured by the dry state detecting unit 336*a*. When the number of circulations scheduled in the time schedule are performed or the sufficient dryness of the print sheet is detected, the dried print sheet is discharged in step S212.

Conversely, if the sufficient dryness of the print sheet is not detected while the scheduled number of circulations have not been performed yet (i.e., the "N" branch from step S211), the circulation is repeated in step S213. During repeating the circulation, the switching operation is controlled between the paper discharge route and the sheet reversing route (the switchback route) for each print sheet. Namely, the circulation is continued by switching the route to the sheet reversing route to perform the decurling process. After circulating all the print sheets the necessary numbers of times (i.e., the "Y" branch from step S214) the print process is completed.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A printing apparatus which forms images on a print sheet by an image forming unit, comprising:

a transportation route including an ordinary transportation route through which a print sheet can be transported through the image forming unit and discharged through a discharge route, and a circulation transportation route which is connected to the ordinary transportation route as a branch and operable to receive the print sheet from the ordinary transportation route and return the print sheet to the ordinary transportation route in order that the transportation route is configured as an annular route around which the print sheet can be circulated a plural number of times;

a print coverage detecting unit operable to calculate the print coverage of an image to be printed on the print sheet by analyzing a characteristic of the image including at least one of the amount and density of ink to be ejected for forming the image on the print sheet by the image forming unit;

a circulation repeat number determination unit operable to determine the number of circulations for the print sheet in accordance with the print coverage calculated by the print coverage detecting unit;

a paper discharge control unit operable to transfer the print sheet transported on the transportation route to the discharge route with a timing in accordance with the number of circulations determined by the circulation repeat number determination unit;

a sheet interval detecting unit operable to detect the interval between print sheets transported on the transportation route; and a paper feed control unit operable to feed print sheets to the transportation route in the order of printing in accordance with the interval between print sheets detected by the sheet interval detecting unit.

2. The printing apparatus as claimed in claim 1 further comprising a dry state detecting unit operable to detect the dry state of the print sheet transported on the transportation route, wherein the circulation repeat number determination unit changes the number of circulations for the print sheet in accordance with the detection result of the dry state detecting unit, wherein the paper discharge control unit transfers the print sheet transported on the transportation route to the discharge route in accordance with the number of circulations which is changed by the circulation repeat number determination unit, wherein the sheet interval detecting unit recalculates the interval between print sheets in accordance with the number of circulations which is changed by the circulation repeat number determination unit, and wherein the paper feed control unit feeds print sheets to the transportation route in accordance with the interval between print sheets as recalculated by the sheet interval detecting unit.

3. The printing apparatus as claimed in claim 1 wherein the circulation transportation route includes a sheet reversing route which is connected to the ordinary transportation route as a branch and operable to receive the print sheet from the ordinary transportation route, reciprocate the print sheet and return the print sheet to the ordinary transportation route in order to reverse the print sheet upside down, and wherein the paper discharge control unit and the paper feed control unit also controls the reversing operation of the print sheet and the speed and timing relating to the image formation on the back side of the print sheet after the reversing operation.

4. The printing apparatus as claimed in claim 3 wherein the paper feed control unit feeds print sheets such that the interval between a preceding print sheet being transported and a subsequent print sheet just fed after the preceding print sheet is no shorter than a predetermined minimum interval plus the distance corresponding to the time required for reversing the subsequent print sheet if the subsequent print sheet is scheduled to be reversed.

5. The printing apparatus as claimed in claim 3 wherein, when the print sheet transported on the transportation route arrives at the junction point between the paper discharge route and the sheet reversing route, the paper discharge control unit judges the consistency in regard to the paper discharging order, the number of circulations and the main and back sides of the print sheet, and controls the switching operation between the sheet reversing route and the ordinary transportation route on the basis of this result of the judgment.

6. The printing apparatus as claimed in claim 1 further comprising a time schedule generation unit operable to generate a time schedule in which are described the speeds, orders and timings of feeding, image forming and transportation of the print sheets to be printed in accordance with the number of circulations determined by the circulation repeat number determination unit, wherein the paper discharge control unit and the paper feed control unit control the driving operations of the circulation transportation route and the ordinary transportation route, the switching operation between the circulation transportation route and the ordinary transportation route, and the speeds and timings of feeding, image forming and transportation of the print sheets in accordance with the time schedule.

7. The printing apparatus as claimed in claim 6 further comprising a dry state detecting unit operable to detect the dry state of the print sheet transported on the transportation route, wherein the time schedule generation unit performs regeneration of the time schedule in accordance with the detection result by the dry state detecting unit, and wherein the paper discharge control unit and the paper feed control unit control the driving operations of the circulation transportation route and the ordinary transportation route, the switching operation between the circulation transportation route and the ordinary transportation route, and the speeds and timings of feeding, image forming and transportation of the print sheets in accordance with the regenerated time schedule.

* * * * *